United States Patent [19]

Plevak et al.

[11] 4,242,014

[45] Dec. 30, 1980

[54] PIVOT JOINT FOR UNDERGROUND MINING INSTALLATIONS

[75] Inventors: Lubomir Plevak, Lunen-Horstmar; Jurgen Dodt, Menden, both of Fed. Rep. of Germany

[73] Assignee: Gewerkschaft Eisenhutte Westfalia, Lunen, Fed. Rep. of Germany

[21] Appl. No.: 7,796

[22] Filed: Jan. 30, 1979

[30] Foreign Application Priority Data

Feb. 30, 1978 [DE] Fed. Rep. of Germany ..... 2803907

[51] Int. Cl.[3] ..... E21D 23/08

[52] U.S. Cl. ..... 405/300; 403/154; 403/353

[58] Field of Search ..... 405/291, 299, 300, 301; 24/201 A, 230 BC, 230 TC; 299/33; 403/151, 154, 157, 353

[56] References Cited

U.S. PATENT DOCUMENTS

| | | | |
|---|---|---|---|
| 649,270 | 5/1900 | Collins | 403/353 X |
| 2,151,837 | 3/1939 | Burke | 24/201 A |
| 2,157,806 | 5/1939 | Tilton | 24/201 A X |
| 3,381,586 | 5/1968 | Rosenberg | 405/300 X |
| 3,891,275 | 6/1975 | Spies | 405/299 X |

*Primary Examiner*—David H. Corbin

*Attorney, Agent, or Firm*—Thompson, Birch, Gauthier & Samuels

[57] ABSTRACT

A releasable pivot joint for use in underground mining installations comprises first and second connecting members. The first connection member has a width which is greater than its thickness and a reduced portion that reduces its width to a core width. The second connection member is formed with a slot into which is inserted the reduced portion of the first connection member. The width of the slot is greater than the thickness and the core width of the first connection member. The length of the slot is greater than the width of the first connection member. The thickness of the second connection member is smaller than the core width of the first connection member. The width of the first connection member extends transversely of the length of the slot when the connection members are in the connected position.

4 Claims, 3 Drawing Figures

PIVOT JOINT FOR UNDERGROUND MINING INSTALLATIONS

BACKGROUND TO THE INVENTION

This invention relates to a releasable pivot joint for use in underground mining installations.

A pivot joint is known having two connection members constituted by a shackle and a bolt which extends transversely through the shackle. The position of the shackle is fixed relative to the bolt by means of stops, discs and cotters, or other securing elements. This pivot joint is advantageously used for connecting the piston-rod of a hydraulic ram to a moving part such as a slide. In this arrangement, the shackle generally forms the connection with the piston-rod, whereas the bolt is secured to the slide or to parts attached to the slide. Although this pivot joint has proved serviceable, it nevertheless suffers from the following disadvantages. Thus, for the purpose of fixing the position of the shackle relative to the bolt, use is made of securing elements, the production and mounting of which involve considerable expense, and the fitting and removal of which can be rendered very difficult by dirt or damage when used in underground mining operations.

The aim of the invention is to provide a releasable pivot joint for use in underground mining installations that is unaffected by dirt and damage, requires no further elements for securing or fixing the connection members together, and which can be readily and rapidly mounted.

SUMMARY OF THE INVENTION

The present invention provides a releasable pivot joint for use in underground mining installations, the pivot joint comprising first and second connection members, the first connection member having a width which is greater than its thickness and a reduced portion that reduces its width to a core width, the second connection member being formed with a slot into which is inserted the reduced portion of the first connection member, the width of the slot being greater than the thickness and the core width of the first connection member, and the length of the slot being greater than the width of the first connection member, the thickness of the second connection member being smaller than the core width of the first connection member, and the width of the first connection member extending transversely of the length of the slot when the connection members are in the connected position.

In this arrangement, the connection members are interconnected in a mating relationship. Moreover, no additional elements are required for securing them together. Assembly and removal are achieved by simply inserting one of the connection members into the other in a particular position. The pivot joint is unaffected by dirt and damage by minerals such as occur in underground mining.

In a preferred embodiment, there are two second connection members each of which is formed with a slot, and wherein the first connection member has two reduced portions that reduce its width to a core width, a respective reduced portion being inserted into the slot of each second connection member, and wherein the relationship between each slot and its associated reduced portion is the same as the of the slot and the reduced portion defined above.

Advantageously, the two reduced portions of the first connection member are symmetrically positioned one on each side of its centre-point. This enables half of the force that is applied to the fist connection member to be transmitted by the pivot joint to each of two support members associated with the two second connection members. Preferably, each of the second connection members is connected to the floor girders of a mine roof-support unit, and the centre of the first connection member is connected to the piston rod of an advance ram of the roof support unit. Here, the floor girders constitute said support members. The advantages of this form of pivot joint are that the floor girders can adapt themselves to irregularities in the mine floor. This is because each of the second connection members can move slightly up and down relative to the first connection member, so that each floor girder can adapt itself to differences in the level of the floor to a predetermined extent. Moreover, each floor girder can pivot by a predetermined amount in the vertical plane extending in the advance direction and transversely thereof. Despite this mobility, this form of pivot joint constitutes a solid load-bearing unit which is capable of taking up large transverse forces.

Conveniently, the or each reduced portion of the first connection member converges inwardly. This permits the connection members to be displaceable relative to one another, to a limited degree, in all directions.

BRIEF DESCRIPTION OF DRAWINGS

Two forms of releasable pivot joint, each constructed in accordance with the invention, will now be described, by way of example, with reference to the accompanying drawings, in which.

BRIEF DESCRIPTION OF PREFERRED EMBODIMENTS

Figure 1:
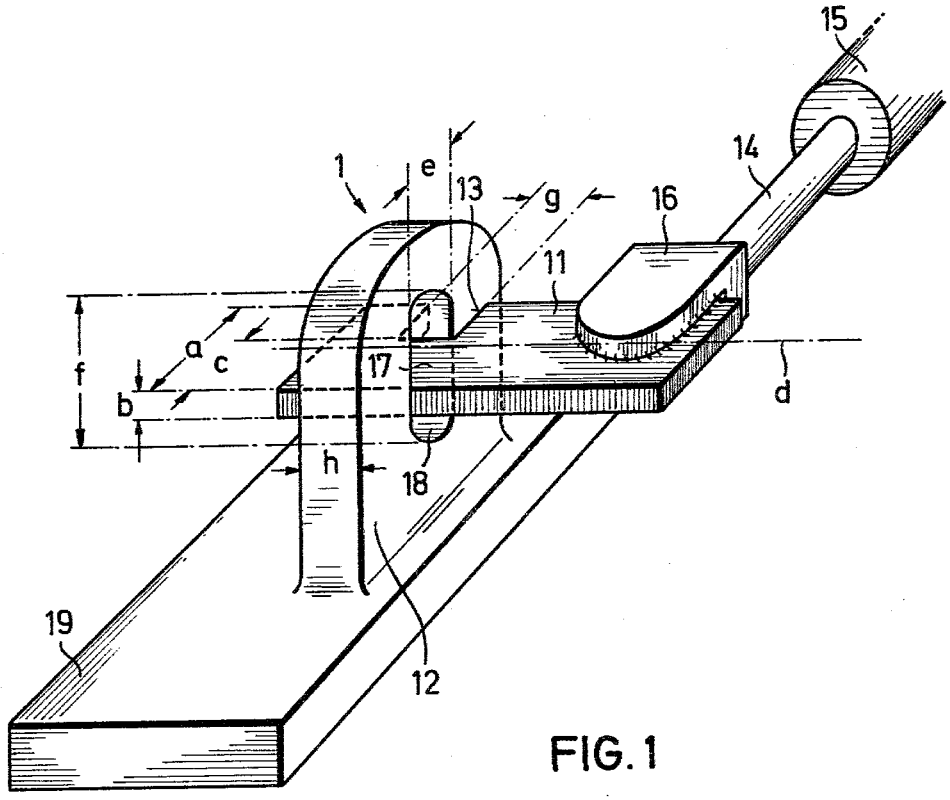
FIG. 1 is a perspective view of the first form of pivot joint.

Referring to the drawings, FIG. 1 shows a pivot joint 1 constituted by a first connection member 11 and a second connection member 12. The first connection member 11 is in the form of a bar and has a width a which is a multiple of its thickness b. The width a is reduced in the zone of a necked portion 13, to a core width c. The piston-rod 14 of a hydraulic ram 15 is secured, by means of a head-piece 16, to the first connection member 11 at the side of the reduced portion 13, the piston-rod 14 extending horizontally and transversely of the longitudinal axis d of the first connection member. The core portion 17 of the first connection member 11 is inserted into a slot 18 formed in the second connection member 12, the reduced portion 13 embracing the sides of the second connection member. The width e of the slot 18 is somewhat greater than the core width c, and the length f of the slot 18 is slightly greater than the width a of the first connection member 11. The second connection member 12 is secured to a slide 19 which is movable by means of the piston-rod 14, in a direction parallel to the longitudinal axis of the piston-rod.

The pivot joint is shown in its connected position, the two connection members 11 and 12 being connected to each other in a mating relationship. Because of the difference between the width e of the slot 18 and the core width c of the first connection member 11 and the difference between the width g of the reduced portion 13 and the thickness h of the second connection member 12, the first connection member 11 is able to execute a pivoting movement in the vertical and horizontal planes. The pivot joint 1 is released by pivoting the first connection member 11 through 90° about its longitudinal axis d, so that it can be withdrawn laterally from the slot 18.

Figure 2:
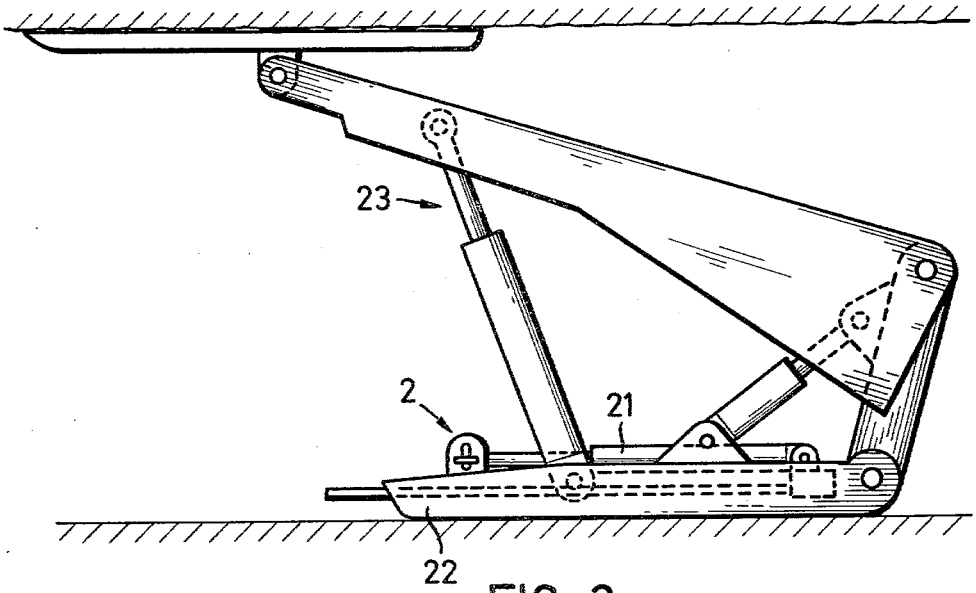
FIG. 2 is a side elevation of a mine roof support unit incorporating the second form of pivot joint.
Figure 3:
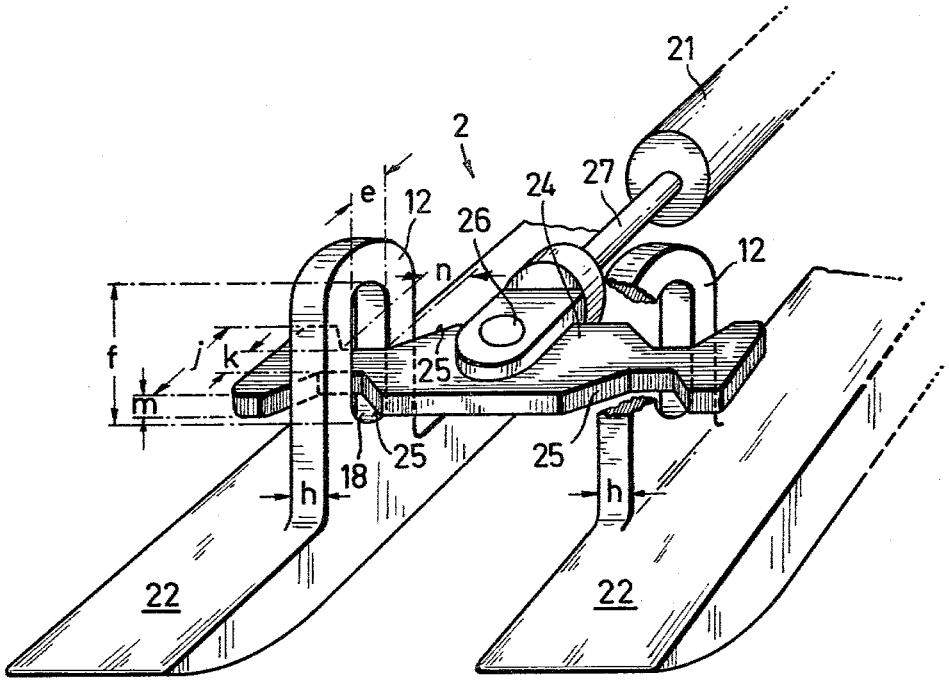
FIG. 3 is a perspective view of the second form of pivot joint.

FIGS. 2 and 3 show a pivot joint 2 for connecting a hydraulic advance ram 21 to the floor girders 22 of a known type of roof support unit 23. The pivot joint 2 differs from the pivot joint 1 of FIG. 1 only in that it has a first connection member 24 provided with two symmetrical positioned reduced portions 25 located one adjacent each of its two ends. Each reduced portion 25 reduces the width j of the connection member 24 to a core width k. As in FIG. 1, the reduced portions 25 engage in slots 18 formed in two second connection members 12 which are secured to the floor girders 22. Thus, as described above with reference to FIG. 1, the piston-rod 27, which engages at the centre 26 of the first connection member 24, is pivoted to the floor girders 22. The reduced portions 25 inwardly converge, the smallest width n of each of these reduced portions being greater than the thickness h of each of the second connection members 12. This increases the ability of the first connection member 24 to pivot in the horizontal plane.

We claim

1. A releasable joint for pivotally connecting the piston rod of an advance ram to a floor sill of a mine roof support unit in an underground mining installation, the pivot joint comprising first and second connection members, the first connection member being connected to said piston rod and having a width which is greater than its thickness and a reduced portion that reduces its width to a core width, the second connection member being connected to said floor sill and being formed with a slot into which is inserted the reduced portion of the first connection member, the width of the slot being greater than the thickness and the core width of the first connection member, and the length of the slot being greater than the width of the first connection member, the thickness of the second connection member being smaller than the core width of the first connection member, and the width of the first connection member extending transversely of the length of the slot when said connection members are in the connection position.

2. A releasable joint for pivotally connecting the piston rod of an advance ram to floor sills of a mine roof support unit in an underground mining installation, the pivot joint comprising a first connection member and two second connection members, the first connection member being connected to said piston rod and having a width which is greater than its thickness and two reduced portions, each of which reduces its width to a core width, each of the second connection members being connected to a respective floor sill and being formed with a slot into which is inserted a respective one of the reduced portions of the first connection member the width of each slot being greater than the thickness and the core width of the first connection member, and the length of each slot being greater than the width of the first connection member, the thickness of each second connection member being smaller than the core width of the first connection member, and the width of the first connection member extending transversely of the length of each slot when the connection members are in the connected position.

3. A pivot joint according to claim 2, wherein the two reduced portions of the first connection member are symmetrically positioned one on each side of its centre-point.

4. A pivot joint according to claim 3, wherein each reduced portion of the first connection member converges inwardly.

* * * * *